US006986187B2

(12) United States Patent
Cummins et al.

(10) Patent No.: US 6,986,187 B2
(45) Date of Patent: Jan. 17, 2006

(54) HINGE ASSEMBLY WITH GLIDE MEMBER

(75) Inventors: Steven O. Cummins, Mansfield, OH (US); Jeffrey D. Habegger, Wadsworth, OH (US); James J. Collene, Bucyrus, OH (US)

(73) Assignee: Mansfield Assemblies Co., Mansfield, OH (US)

( * ) Notice: Subject to any disclaimer, the term of this patent is extended or adjusted under 35 U.S.C. 154(b) by 0 days.

(21) Appl. No.: 10/441,697

(22) Filed: May 20, 2003

(65) Prior Publication Data

US 2003/0213098 A1 Nov. 20, 2003

Related U.S. Application Data

(60) Provisional application No. 60/381,900, filed on May 20, 2002.

(51) Int. Cl.
*E05F 1/08* (2006.01)

(52) U.S. Cl. ..... 16/286; 16/306; 126/194

(58) Field of Classification Search ..... 16/286–288, 16/306, 317, 365, 366, 368, 370; 126/191, 126/194; 49/445–447
See application file for complete search history.

(56) References Cited

U.S. PATENT DOCUMENTS 3,327,701 A * 6/1967 Smith ..... 126/194
3,450,125 A 6/1969 Hopkins
3,677,259 A * 7/1972 Doner ..... 126/194
3,712,287 A * 1/1973 Summers, Jr. ..... 126/191
3,838,538 A * 10/1974 Burford ..... 49/258
3,842,542 A * 10/1974 White et al. ..... 49/386
5,025,776 A * 6/1991 Hanley et al. ..... 126/194
5,341,542 A * 8/1994 Hannan et al. ..... 16/289
5,822,925 A 10/1998 McKinney et al.
5,937,481 A * 8/1999 Faringosi ..... 16/332
6,035,848 A * 3/2000 Ray et al. ..... 126/194
6,397,836 B1 * 6/2002 Pelletier et al. ..... 126/194
6,453,510 B1 * 9/2002 Cummins et al. ..... 16/343

FOREIGN PATENT DOCUMENTS

EP 1 302 150 A1 4/2003

* cited by examiner

*Primary Examiner*—Chuck Y. Mah
*Assistant Examiner*—Michael J. Kyle
(74) *Attorney, Agent, or Firm*—Fay, Sharpe, Fagan, Minnich & McKee, LLP

(57) ABSTRACT

A hinge assembly for an appliance includes a claw and a channel pivotably connected to the claw. A link assembly is operably connected between the claw and the channel. The link assembly includes a link connected to the claw and a lever connected to the link. A glide member is connected to the lever and movably engaged with said channel. The glide member is slidably movable between first and second operative positions in response to movement of the channel relative to the claw between first and second positions, respectively. A spring is operably connected to a first end of the lever and biases the glide member into engagement with the channel.

20 Claims, 6 Drawing Sheets

HINGE ASSEMBLY WITH GLIDE MEMBER

CROSS-REFERENCE TO RELATED APPLICATION

This application claims benefit of the filing date of and priority from U.S. provisional application No. 60/381,900 filed May 20, 2002.

BACKGROUND OF THE INVENTION

The present invention relates to a novel and non-obvious hinge assembly. More particularly, the subject development relates to a new and improved hinge assembly for movably connecting the door of an appliance (e.g. an oven) to the body of the appliance.

A hinge assembly of the type illustrated in FIGS. 1–4 is widely known.

The hinge assembly A' includes a claw B' adapted for connection to an appliance frame or chassis, and a first end C1' of a channel C' is pivotally connected to the claw B' at a pivot point D' so that the channel is adapted for bi-directional movement on an arc E' relative to the claw. The channel C' typically comprises a U-shaped cross-section (see FIG. 2) so as to define an open recess. The pivotable interconnection between the first end C1' of the channel and the claw B' is provided by a rivet, pin or other fastener R1'. The channel C' is adapted for connected to an appliance door such as an oven door is generally well known in the art of appliance hinge assemblies.

The claw B' and the channel C' are also operably interconnected through a link assembly F'. The link assembly F' comprises at least one and typically first and second parallel, identical link members G1',G2' (FIGS. 2 and 4) that are pivotally connected at their first ends G1–1',G2–1' to the claw B' by a rivet, pin or other fastener R2'. The link members are connected at their opposite, second ends G1–2', G2–2' to the first end H1' of a spring H' such as a coil spring (shown partially in phantom lines for clarity), usually by way of a transversely extending rivet, pin or other fastener R3'. The opposite, second end H2' of the coil spring is secured directly to a second end C2' of the channel, or indirectly through a rivet, pin or other member connected to the channel.

A link control member such as a roller I' spans the channel C' adjacent the link members G1',G2', and the link members G1',G2' each define a contact surface J' that moveably engages the roller I'. The link member G1',G2' also each define a catch or dwell point K' that is adapted to receive and retain the roller I' when the channel C' is pivoted a maximum distance away from the claw B' on the arc E' (FIG. 3). When the roller I' is seated in the dwell point K', further movement of the channel C' on the arc E' in the first direction E1' is prevented. The contact surface J' of each link member G1',G2' also defines a lobe or other feature M' adjacent the link first end that is conformed to engage the roller I' when the channel is in its first operative position and urge the channel member C' rearwardly (to the right in FIG. 1) so that the channel member is securely held in its first operative position whereby a door connected to the channel is urged firmly into the closed position.

In operation, the channel C (and a door connected thereto) is pivotally moveable on the arc E' to and between two operative positions: (i) a first operative position (FIGS. 1, 2, 4) wherein the coil spring H' is relatively relaxed and wherein the roller I' is spaced from the dwell point K'; and, (ii) a second operative position (FIG. 3) wherein the channel C' is pivoted a maximum distance away from the claw B' in the first direction E1' so that the coil spring H' is relatively tensioned and elongated and so that the link members G1',G2' are moved toward the channel first end C1' until the roller I' is seated in the dwell point K' of links G1',G2'. Those of ordinary skill in the art will recognize that when the channel C' is moved from the first operative position to the second operative position, the link assembly F' moves away from the second end C2' of the channel. In contrast, when the channel C' is moved in the opposite direction from the second operative position to the first operative position, the link assembly F' moves toward the channel second end C2'.

Appliance consumers have come to equate appliance quality with smooth and dampened movement of the appliance door relative to the appliance body. As such, appliance hinge manufactures have become focused on designing and manufacturing hinge assemblies that provide smooth and dampened door movement. Of course, competitive pressures require that hinge assemblies be manufactured at the lowest possible cost. This requires minimizing hinge complexity to reduce material and labor costs. Furthermore, owing to the widespread commercial success of hinges such as that illustrated in FIGS. 1–4, it has been deemed desirable to provide hinges of this same basic design, that exhibit improved smoothness and a more dampened feel during use.

SUMMARY OF THE INVENTION

In accordance with the present invention, a hinge assembly includes a claw adapted for connection to an associated appliance chassis and a channel pivotably connected to the claw. The channel is adapted for connection to an associated appliance door. The hinge assembly further includes a link assembly. The link assembly includes: (i) at least one link having a first end pivotably connected to the claw; and, (ii) at least one lever connected to the at least one link. The at least one lever includes a glide member slidably engaged with the channel. A spring is operably engaged between the link assembly and the channel. The spring is connected to a first end of the at least one lever and the glide member is located at a second end of the at least one lever.

According to a further aspect of the present invention, a hinge assembly includes a claw and a channel pivotably connected to the claw. A link assembly includes a link connected to the claw and a lever connected to the link. The lever includes a glide member movably engaged with the channel. A spring is operably connected to a first end of the lever and biases the glide member into movable engagement with the channel.

In accordance with another aspect of the present invention, a hinge assembly for an appliance includes a claw and a channel pivotably connected to the claw. A link assembly is operably connected between the claw and the channel. The link assembly includes a link connected to the claw and a lever connected to the link. A glide member is connected to the lever and movably engaged with said channel. The glide member is slidably movable between first and second operative positions in response to movement of the channel relative to the claw between first and second positions, respectively. A spring is operably connected to a first end of the lever and biases the glide member into continuous engagement with the channel.

One advantage of the present invention resides in the provision of a hinge assembly that exhibits improved counter-balance characteristics.

Another advantage of the present invention is found in the provision of a hinge assembly that exerts an improved pull-in or sealing force on the associated appliance door relative to the associated appliance body.

A further advantage of the present invention relates to the provision of a hinge assembly that allows for smooth and dampened door movement in a cost-effective manner.

Still another advantage of the present invention resides in the provision of a hinge assembly wherein hinge movement and feel are less sensitive to variations in spring forces (due to weakening of the spring and/or manufacturing tolerances) and this, in turn, allows a spring of a particular strength to be used over a wider range of applications.

Still other benefits and advantages of the invention will become apparent to those of ordinary skill in the art to which the invention pertains upon reading the following specification.

BRIEF DESCRIPTION OF THE DRAWINGS

The invention comprises a variety of components and arrangements of components, preferred embodiments of which are illustrated in the accompanying drawings that form a part hereof and wherein.

DETAILED DESCRIPTION OF THE PREFERRED EMBODIMENT

Figure 1:
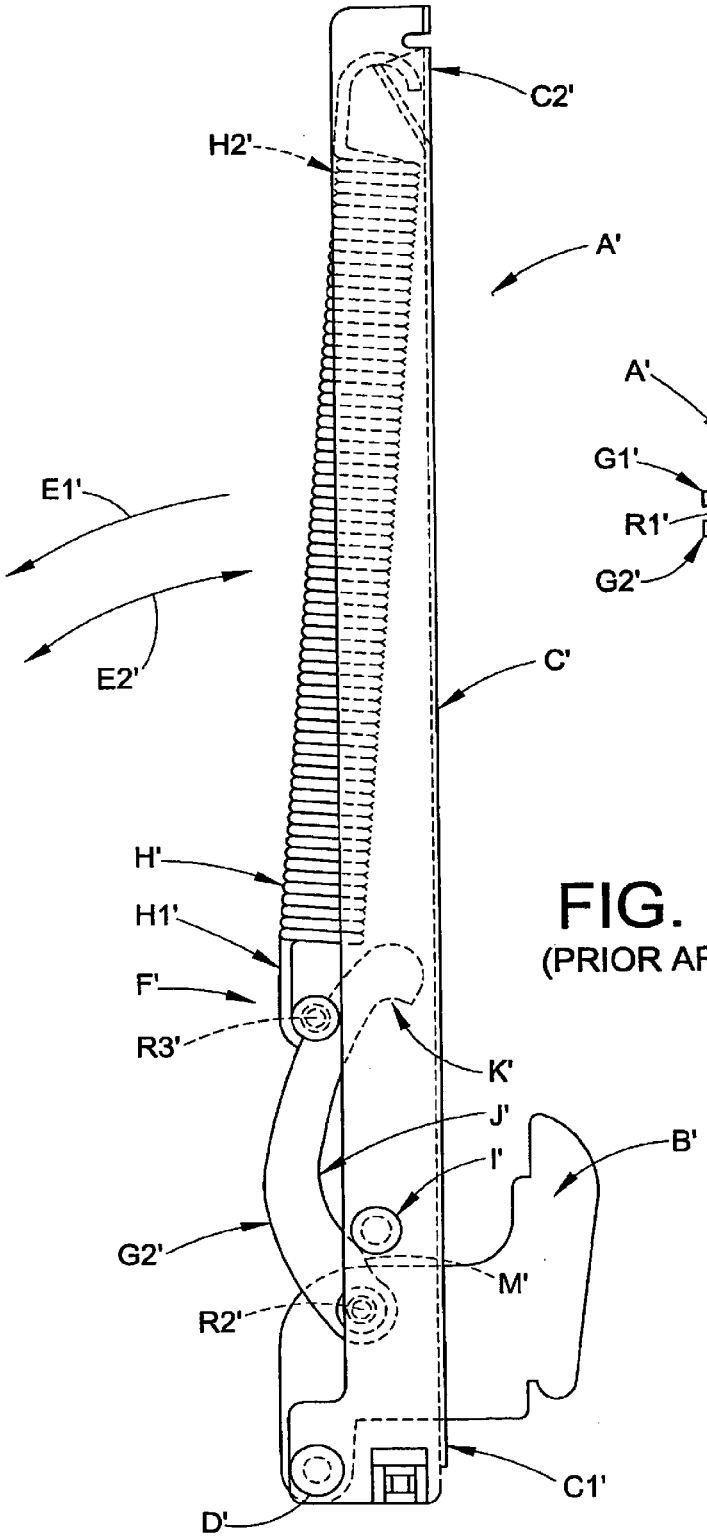
FIG. 1 (PRIOR ART)
FIG. 1 (prior art) is a side elevational view of a prior art hinge assembly in a first operative position.
Figure 2:
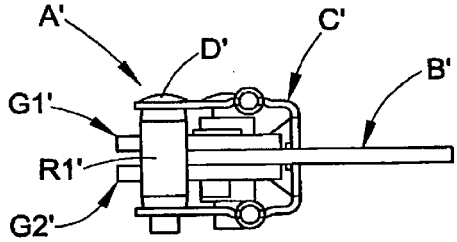
FIG. 2 (PRIOR ART)
FIG. 2 (prior art) is a bottom view of the hinge assembly shown in FIG. 1.
Figure 3:
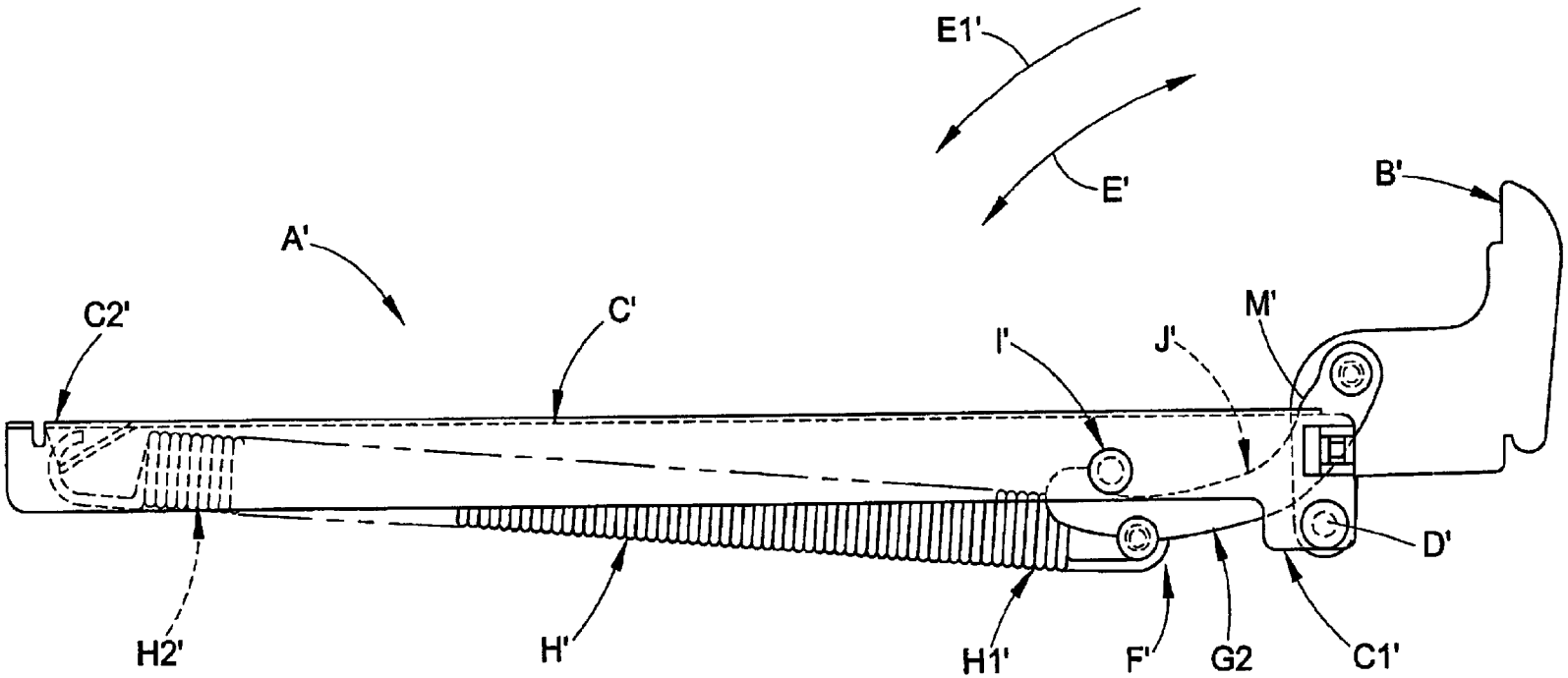
FIG. 3 (PRIOR ART)
FIG. 3 (prior art) is a side elevational view of the hinge assembly shown in FIG. 1 in a second operative position.
Figure 4:
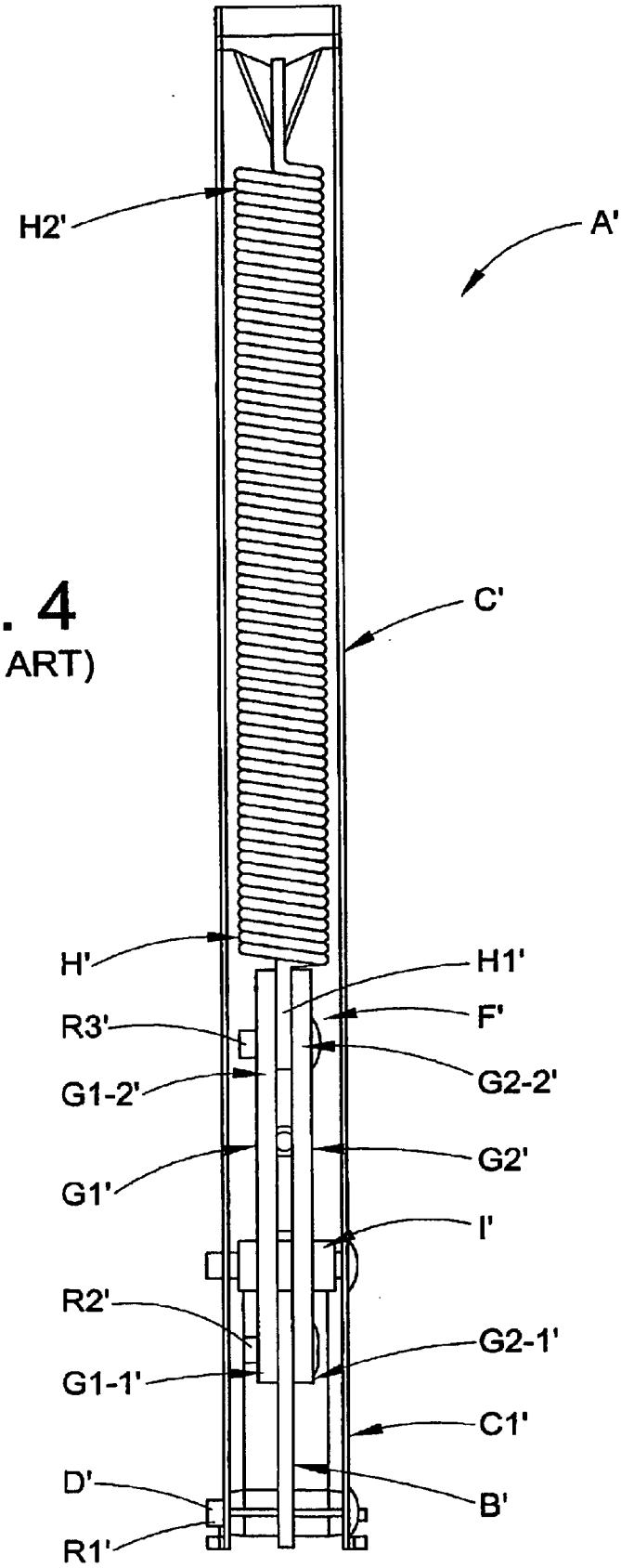
FIG. 4 (PRIOR ART)
FIG. 4 (prior art) is a front elevational view of the hinge assembly shown in FIG. 1.
Figure 5:
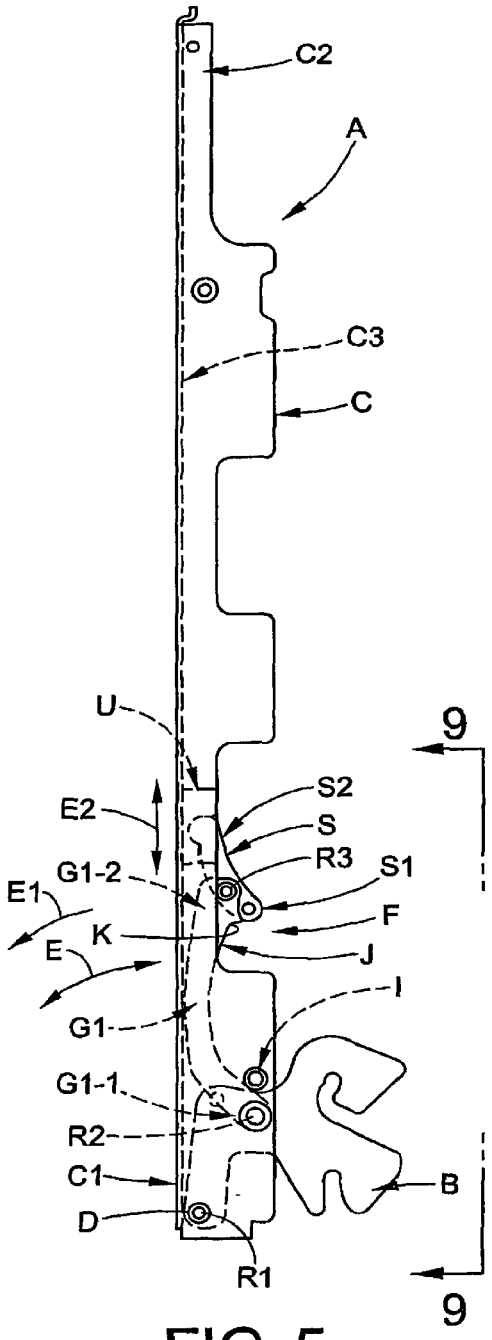
FIG. 5 is a side elevational view of a hinge assembly formed in accordance with the present invention (with a spring thereof not shown for clarity) in a first operative (closed) position.

Referring now to FIGS. 5–8, wherein the showings are for purposes of illustrating a preferred embodiment of the invention only and not for purposes of limiting the invention, a hinge assembly A formed in accordance with the present invention is illustrated. In general, except as otherwise shown and/or described, the hinge assembly A is structured and operates similarly to the hinge assembly A' illustrated in FIGS. 1–4. Accordingly, corresponding components of the hinge assembly A relative to the hinge assembly A' are identified with like reference numerals/letters without the primed (') suffix. New components of the hinge assembly A relative to the hinge assembly A are identified with new reference numerals/letters.

An important difference of the hinge assembly A relative to the hinge assembly A' is that the channel C is reversed relative to the channel C'. As such, the U-shaped recess of the channel C is open toward the claw B (and toward the associated appliance frame to which the claw is connected) while the U-shaped recess of the channel C' opens away from the claw B' (and away from the associated appliance frame to which the claw is connected).

The hinge assembly A includes a claw B adapted for connection to an appliance frame or chassis, and a first end C1 of a channel C is pivotally connected to the claw B at a pivot point D so that the channel is adapted for bi-directional movement on an arc E relative to the claw. The pivotable interconnection between the first end C1 of the channel C and the claw B is provided by a rivet, pin or other fastener R1. The channel C is adapted for connection to an appliance door such as an oven door is generally well known in the art of appliance hinge assemblies. The channel C need not have a U-shaped cross-section as illustrated herein. Also, the channel C need not be a one-piece construction and can comprise other members connected thereto.

The claw B and the channel C are also operably interconnected through a link assembly F. The link assembly F preferably comprises at least one link or link member G1 that is pivotally connected at its first ends G1–1 to the claw B by a rivet, pin or other fastener R2. Those of ordinary skill in the art will recognize that the link assembly F can comprise two or more the link members including the link member G1 and others formed similarly or identically thereto.

The link assembly F further comprises at least one lever member S connected to the second end G1–2 of the link member G1 by a rivet R3, pin or other fastener or other suitable connection means. More particularly, the lever member S comprises a first end S1 and a second end S2. As shown herein, the lever member S is pivotably connected to the link member G1 at a point located generally between the first and second ends S1,S2. When the link assembly F comprises two link members including the link member G1 and another link member, the lever member S is preferably sandwiched between the two link members.

Figure 7:
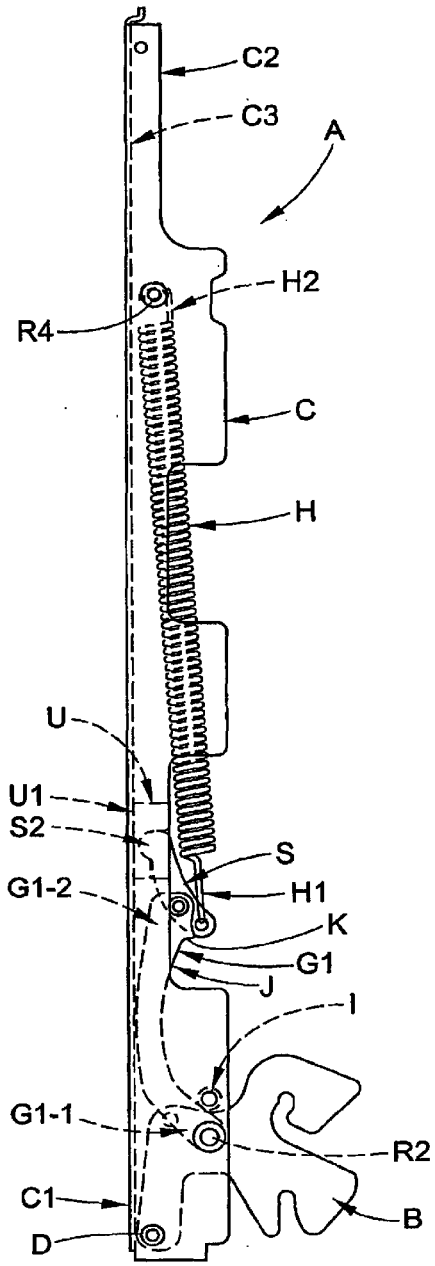
FIGS. 7 and 8 correspond respectively to FIGS. 5 and 6 but also show a spring operatively positioned; and, FIG. 9 is a partial view of the hinge assembly taken along line 9—9 of FIG. 5.
Figure 8:
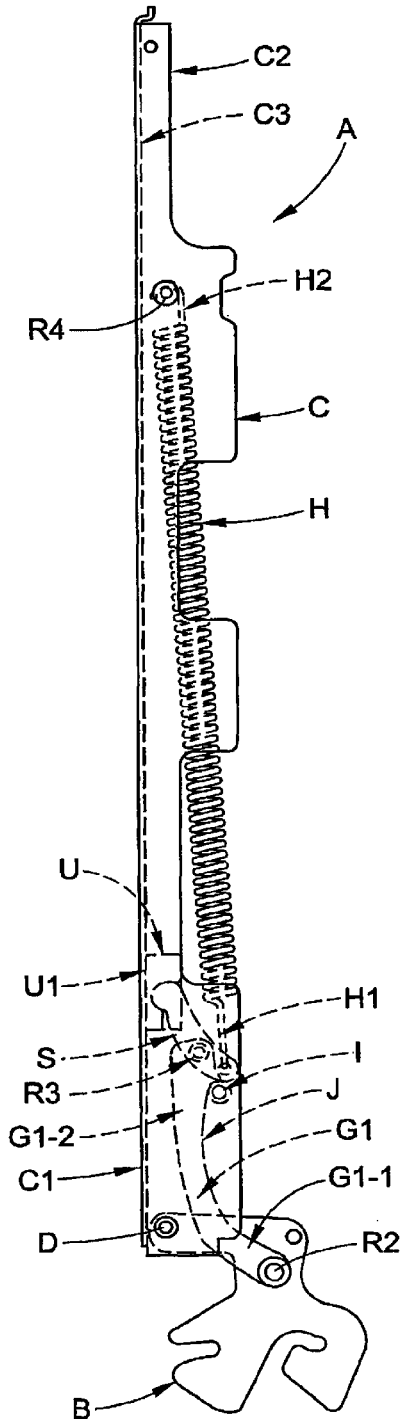

The first end S1 of the lever member S includes an aperture or is otherwise conformed or includes other means for being engaged by a first end H1 of the spring H as shown in FIGS. 7 and 8. The opposite, second end H2 of the coil spring H defines a hook or the like and is secured directly to a second end C2 of the channel C or is secured to the channel C indirectly through a rivet, pin or other member R4 that is, itself, connected to the channel second end. In either case, the spring H is operably connected between the link assembly F and channel C.

Figure 9:
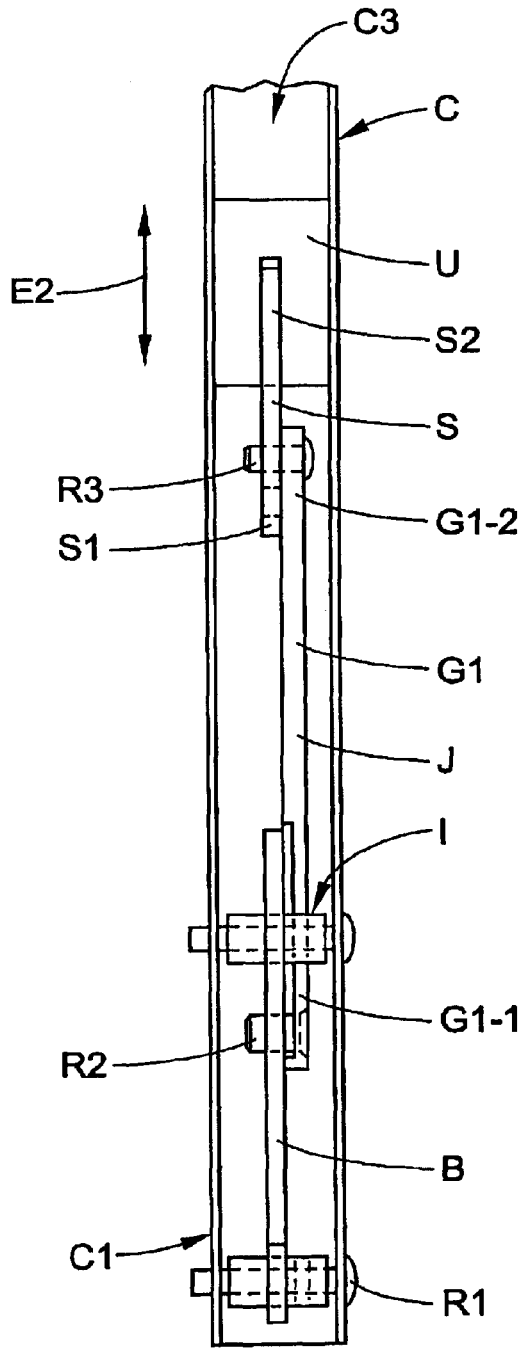

With reference also to FIG. 9, the second end S2 of the lever member S is conformed to engage a glide member U that is slidably movable in the channel C and slidably engaged with the channel C. In the illustrated embodiment, the second end S2 of the lever member S is conformed with a hook or other male protrusion and the glide member U is defined with a mating female conformation whereby the second end S2 of the lever member S is directly engageable with the glide member U without requiring a fastener, adhesive or other fastening means.

The glide member U is defined from any suitable material such as metal or a polymeric material. In the preferred embodiment, the glide member U is defined from a polymeric material such as a molded plastic material (e.g., Nylon) and is closely received in the channel C so that the glide member U can slide axially toward and away from the first and second ends C1,C2 of the channel (as indicated by the double-ended arrow E2) but cannot move more than minimally in a lateral direction within the channel C. Also, the combination of the lever member S and the spring H urge a bearing surface U1 of the glide member U into abutment with the channel C at all times. Preferably, the bearing surface U1 of glide member U slidably engages an inner wall C3 of the channel. If desired, a viscous lubricant such as a heavy grease can be used at the interface between the bearing surface U1 and the channel C to provide the hinge assembly A with a more smooth and dampened feel during use.

The glide member U need not be defined separately from the lever member S and can be integral therewith or even formed as a one-piece construction with the lever member S. In one embodiment, the second end S2 of the lever member S is, itself, conformed to define a metallic glide member U including a bearing surface U1. In another embodiment, a plastic glide member U is insert-molded to the second end S2 of the lever member S. It should be noted that the channel C can optionally comprise a member connected thereto that defines a surface against which said glide member U bears and, in such case, the glide member U is still deemed to be "slidably engaged" with the channel C, i.e., any such additional member connected to the channel C and providing a surface against which the glide member U bears is deemed to be part of the channel C.

A link control member I such as a roller or a simple cross-pin or rivet spans the channel C adjacent the link member G1. The link member G1 defines a contact edge or surface J that movably engages the roller or other link control member I when the link member G1 moves during operation of the hinge assembly A as described in further detail below.

Figure 6:
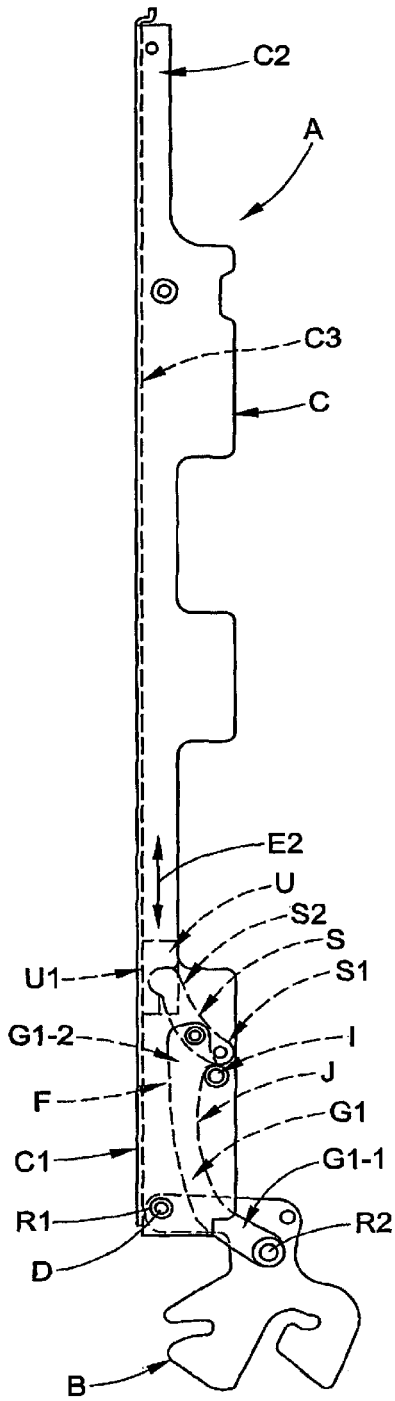
FIG. 6 is a side view of the hinge assembly shown in FIG. 5 in a second operative (opened) position.

The link member G1 also defines a catch or dwell point K that is adapted to receive and retain the link control member I when the channel C is pivoted a maximum distance in the first direction E1 away from the claw B on the arc E to its second operative position (FIGS. 6 and 8). When the roller or other link control member I is seated in the dwell point K, further movement of the channel C on the arc E in the first direction E1 is prevented.

It is important to note that the lever member S is connected to the link member G1 in a manner such that when the first end S1 of the lever member S is urged toward the second end C2 of the channel C by the spring H, the second end S2 of the lever member S pushes on the glide member U and biases same into abutment with the channel C, in particular, an inner wall C3 of the channel. This, in turn, causes the lever member S to exert a force on the link member G1 that urges same away from the inner wall C3 of channel C so that the contact surface J of the link member G1 is biased into firm and continuous contact with the roller or other link control member I that spans the open channel for all positions of the channel C relative to the claw B. Accordingly, those of ordinary skill in the art will recognize that the presence and arrangement of the lever member S as disclosed herein ensures firm contact between the link member G1 and the roller or other link control member I at all times which causes the hinge assembly A to exhibit smooth and dampened movement when the channel C is moved in either direction and to any position on the arc E. Furthermore, the friction between the bearing surface U1 of the glide member U and the channel C (and any viscous lubricant at this interface) further dampens movement of the channel C when the channel C is moved either direction on the arc E and this friction also results in a counter-balancing force or dampening effect to movement of the channel C relative to the claw B.

In operation, the channel C (and a door or other structure connected thereto) is pivotally moveable bi-directionally on the arc E in the first direction E1 and an opposite second direction to and between two operative positions: (i) a first operative position (FIGS. 5, 7 and 9) wherein the coil spring H is shortened and wherein the roller or other link control member I is spaced from the dwell point K; and, (ii) a second operative position (FIGS. 6 and 8) wherein the channel C is pivoted a maximum distance away from the claw B in the first direction E1 so that the coil spring H is tensioned and elongated and so that the link member G1 is moved toward the channel first end C1 until the roller or other link control member I is seated in the dwell point K. Those of ordinary skill in the art will recognize that when the channel C is moved from the first operative position to the second operative position, the entire link assembly F (including the link member G1, the lever member S and the glide member U) moves away from the second end C2 of the channel C. In contrast, when the channel C is moved in the opposite direction from the second operative position to the first operative position, the entire link assembly F moves toward the channel second end C2. This movement of the entire link assembly F is indicated by the arrow E2.

As noted, during pivoting movement of the channel C relative to the claw B in the first direction E1 or an opposite direction, the spring H acts on the lever S to cause the glide member U to be urged into contact with the channel inner wall C3 which, in turn, causes the link member G1 to be biased away from the inner wall C3 and into continuous firm contact with the link control member I. Owing to the sliding contact between the bearing surface U1 of the glide member U and the channel inner wall C3, movement of the channel C in either direction on the arc E is smooth and dampened relative to conventional hinge assemblies such as that shown in FIGS. 1–4.

The channel C, claw B, link member G1 and lever member S are preferably all defined from and/or comprise metal stampings. These members need not be one-piece constructions. It is contemplated that any or all of these components be made from or comprise other suitable materials such as polymeric materials or the like.

Based upon the foregoing, those of ordinary skill in the art will recognize that the hinge assembly A comprises a link assembly F that includes a glide member that is slidably engaged with the channel C when the channel moves to and between the first and second operative positions. The engagement of the glide member U with the channel under force of spring H results in the link G1 of link assembly F being biased into engagement with the link control member I as desired for all positions of the channel C relative to the claw B.

The invention has been described with reference to preferred embodiments. Of course, modifications and alterations will occur to others upon a reading and understanding of the preceding specification. It is intended that the invention be construed as including all such modifications and alterations.

What is claimed is:

1. A hinge assembly comprising:

a claw adapted for connection to an associated appliance chassis;

a channel pivotably connected to said claw and adapted for connection to an associated appliance door, said channel defining a recess;

a link control member connected to said channel and spanning said recess;

a link assembly comprising: (i) at least one link having a first end pivotably connected to said claw; and, (ii) at least one lever pivotably connected to said at least one link, said at least one lever comprising a glide member located in said recess and slidably engaged with said channel;

a spring operably engaged between said link assembly and said channel, said spring connected to a first end of said at least one lever, wherein said glide member is located at a second end of said at least one lever, and wherein said spring urges said glide member into engagement with said channel and urges said at least one link into engagement with said link control member when said channel moves to an between said first and second operative positions.

2. The hinge assembly as set forth in claim 1, wherein said at least one lever is connected to said at least one link at a point generally between said first and second ends of said at least one lever.

3. The hinge assembly as set forth in claim 1, wherein said at least one lever is pivotably connected to said at least one link.

4. The hinge assembly as set forth in claim 1, wherein said glide member is defined as a one-piece construction with said at least one lever.

5. The hinge assembly as set forth in claim 1, wherein said glide member comprises a polymeric member connected to said at least one lever.

6. The hinge assembly as set forth in claim 1, wherein said spring comprises a coil spring.

7. A hinge assembly comprising:

a claw adapted for connection to an associated appliance chassis;

a channel pivotably connected to said claw and adapted for connection to an associated appliance door;

a link assembly comprising: (i) first and second links each having a first end pivotably connected to said claw; and, (ii) at least one lever connected to said first and second links, said at least one lever comprising a glide member slidably engaged with said channel;

a spring operably engaged between said link assembly and said channel, said spring connected to a first end of said at least one lever and said glide member located at a second end of said at least one lever;

wherein said at least one lever is sandwiched between said first and second links.

8. A hinge assembly comprising:

a claw adapted for connection to an associated appliance chassis;

a channel pivotably connected to said claw and adapted for connection to an associated appliance door, wherein said channel pivots relative to said claw between first and second operative positions;

a link assembly comprising: (i) at least one link having a first end pivotably connected to said claw, said at least one link comprising a contact surface; and, (ii) at least one lever connected to said at least one link, said at least one lever comprising a glide member slidably engaged with said channel;

a spring operably engaged between said link assembly and said channel, said spring connected to a first end of said at least one lever and said glide member located at a second end of said at least one lever;

a link control member connected to said channel, wherein said spring urges said glide member into engagement with said channel and wherein said lever urges said contact surface of said at least one link into continuous and uninterrupted engagement with said link control member when said channel moves to an between said first and second operative positions.

9. The hinge assembly as set forth in claim 8, wherein said at least one link defines a dwell point that receives said link control member when said channel is pivoted to said second operative position.

10. A hinge assembly comprising:

a claw;

a channel pivotably connected to said claw;

a link assembly comprising a link connected to said claw and comprising a lever connected to said link, said lever comprising a glide member movably engaged with said channel;

a spring operably connected to a first end of said lever and biasing said glide member into movable engagement with said channel; and a link control member connected to said channel, wherein said spring urges said glide member into engagement with said channel and wherein said lever urges said contact surface of said link into continuous and uninterrupted engagement with said link control member when said channel moves to an between first and second operative positions.

11. The hinge assembly as set forth in claim 10, wherein said channel defines a recess and wherein said glide member is movably located in said recess.

12. The hinge assembly as set forth in claim 10, wherein said glide member is located adjacent a second end of said lever and wherein said lever is connected to said link at a point generally between said first and second ends of said lever.

13. The hinge assembly as set forth in claim 10, wherein said lever is pivotably connected to said link.

14. The hinge assembly as set forth in claim 10, wherein said glide member is defined as a one-piece construction with said lever.

15. The hinge assembly as set forth in claim 10, wherein said glide member comprises a polymeric member connected to said lever.

16. The hinge assembly as set forth in claim 10, wherein said spring comprises a coil spring.

17. The hinge assembly as set forth in claim 10, wherein said link and said lever are each one-piece members.

18. A hinge assembly comprising:

a claw;

a channel pivotably connected to said claw, wherein said channel pivots relative to said claw between first and second operative positions;

a link assembly comprising a link connected to said claw and comprising a lever connected to said link, said lever comprising a glide member movably engaged with said channel, wherein said link comprises a contact surface; and, a link control member connected to said channel, wherein said spring urges said glide member into engagement with said channel and wherein said lever urges said contact surface of said link into engagement with said link control member when said channel moves to an between said first and second operative positions.

19. A hinge assembly for an appliance comprising:

a claw;

a channel pivotably connected to said claw, said channel defining a recess;

a link control structure connected to said channel;

a link assembly operably connected between said claw and said channel, said link assembly comprising a link pivotably connected to said claw and a lever pivotally connected to said link between opposite first and second ends of said lever;

a glide member connected to a second end of said lever and located in said recess of said channel and movably engaged with said channel, said glide member slidably movable between first and second operative positions in response to movement of said channel relative to said claw between first and second positions, respectively;

a spring operably connected to a first end of said lever and biasing said glide member into continuous engagement with said channel and urging said link away from said channel into abutment with said link control structure.

20. The hinge assembly as set forth in claim 19, wherein said glide member comprises a polymeric body.

* * * * *